US012753673B2

(12) United States Patent
Greci et al.

(10) Patent No.: US 12,753,673 B2
(45) Date of Patent: Oct. 6, 2026

(54) FLOW CONTROL SYSTEM HAVING A RATE LIMITING DEVICE FOR WELL SYSTEMS

(71) Applicant: Halliburton Energy Services, Inc., Houston, TX (US)

(72) Inventors: Stephen Michael Greci, Carrollton, TX (US); Ryan W. McChesney, Carrollton, TX (US); Finn Gamble McCarthy, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/893,134

(22) Filed: Sep. 23, 2024

(65) Prior Publication Data

US 2026/0085592 A1 Mar. 26, 2026

(51) Int. Cl.
*E21B 34/08* (2006.01)

(52) U.S. Cl.
CPC ..... *E21B 34/08* (2013.01)

(58) Field of Classification Search
CPC ..... E21B 34/08; E21B 2200/03
See application file for complete search history.

(56) References Cited

U.S. PATENT DOCUMENTS 5,706,897 A * 1/1998 Horton, III ..... E21B 43/01 166/359
5,839,508 A 11/1998 Tubel et al.
7,246,660 B2 7/2007 Fripp et al.
10,619,435 B2 4/2020 Greci et al.
11,041,361 B2 6/2021 Fripp et al.
11,236,587 B2 2/2022 Greci et al.
11,649,686 B2 5/2023 McChesney et al.
2009/0008078 A1 1/2009 Patel
2009/0101329 A1 4/2009 Clem et al.
2009/0283275 A1 11/2009 Hammer
2009/0294123 A1 12/2009 Mescall et al.
2012/0255739 A1 * 10/2012 Fripp ..... E21B 43/12 166/373
2015/0040990 A1 2/2015 Mathiesen et al.
2017/0306725 A1 10/2017 Hunter
2018/0340413 A1 11/2018 Shah et al.
(Continued)

OTHER PUBLICATIONS

"PCT Application No. PCT/US2023/075278 International Search Report and Written Opinion", Jun. 25, 2024, 10 pages.
(Continued)

*Primary Examiner* — Cathleen R Hutchins
(74) *Attorney, Agent, or Firm* — DeLizio, Peacock, Lewin and Guerra, LLP

(57) ABSTRACT

Systems, methods, and apparatus for fluid flow control in a flow control device of a well system. The flow control device may include a fluid sensor that may be configured to sense a fluid extracted from a subsurface formation and modify a fluid flow through the flow control device based on one or more fluid properties of the sensed fluid. The flow control device may include a rate limiting device that may be configured to limit a flow rate of the fluid through the fluid sensor to a flow rate threshold. The rate limiting device may be coupled between an inlet of the flow control device and the fluid sensor to limit the fluid flow rate through the fluid sensor.

21 Claims, 7 Drawing Sheets

(56) References Cited

U.S. PATENT DOCUMENTS

| | | | | |
|---|---|---|---|---|
| 2019/0055814 | A1 | 2/2019 | Frosell et al. | |
| 2020/0040676 | A1 | 2/2020 | Greci et al. | |
| 2020/0063518 | A1* | 2/2020 | Fripp | E21B 43/14 |
| 2020/0300740 | A1 | 9/2020 | Fripp et al. | |
| 2021/0062615 | A1* | 3/2021 | Fripp | E21B 34/08 |
| 2022/0112793 | A1 | 4/2022 | Difoggio | |
| 2023/0003628 | A1 | 1/2023 | Peters | |
| 2024/0026762 | A1 | 1/2024 | Shaw | |
| 2025/0101836 | A1 | 3/2025 | Greci et al. | |

OTHER PUBLICATIONS

"U.S. Appl. No. 18/474,911 Non-Final Office Action", Mar. 19, 2025, 13 pages.
"PCT Application No. PCT/US2024/050293 International Search Report and Written Opinion", Jun. 16, 2025, 9 pages.
"U.S. Appl. No. 18/474,911 Final Office Action", Aug. 28, 2025, 16 pages.
"U.S. Appl. No. 18/474,911 Non-Final Office Action", Nov. 25, 2025, 20 pages.

* cited by examiner

FLOW CONTROL SYSTEM HAVING A RATE LIMITING DEVICE FOR WELL SYSTEMS

TECHNICAL FIELD

The present invention relates generally to oil and gas systems and services, and more specifically to a flow control system having a rate limiting device for well systems.

BACKGROUND

The oil and gas services industry uses various types of well equipment and tools in well systems at well sites. Well systems may include flow control devices to control fluid flow at various zones of a well. For example, flow control devices may be used in a horizontal section of a well system to control fluid flow (e.g., oil, gas, and water) at various zones of the well during a fracturing operation. Flow control devices may be used to detect when undesired fluids are being extracted from the subsurface formation. The flow control device may modify and restrict the fluid flow through the flow control device to restrict the flow rate of the undesired fluids. In some cases, since the flow control devices reduce the flow rate of the undesired fluid by such a large margin, the flow rate through the subsurface formation is reduced in that zone, thereby increasing the differential pressure across the flow control device. This increased differential pressure across the flow control device may cause excessive wear and erosion in components of the flow control device, and may cause excess undesired fluid production through the flow control device if the flow control device uses a conventional fixed nozzle.

DESCRIPTION

The description that follows includes example systems, methods, techniques, and program flows that describe aspects of the disclosure. However, it is understood that this disclosure may be practiced without these specific details. For instance, this disclosure refers to certain well systems, devices, or tools in illustrative examples. Aspects of this disclosure can be instead applied to other types of well systems, devices, and tools. In other instances, well-known instruction instances, protocols, structures, and techniques have not been shown in detail to avoid confusion.

Figure 1:
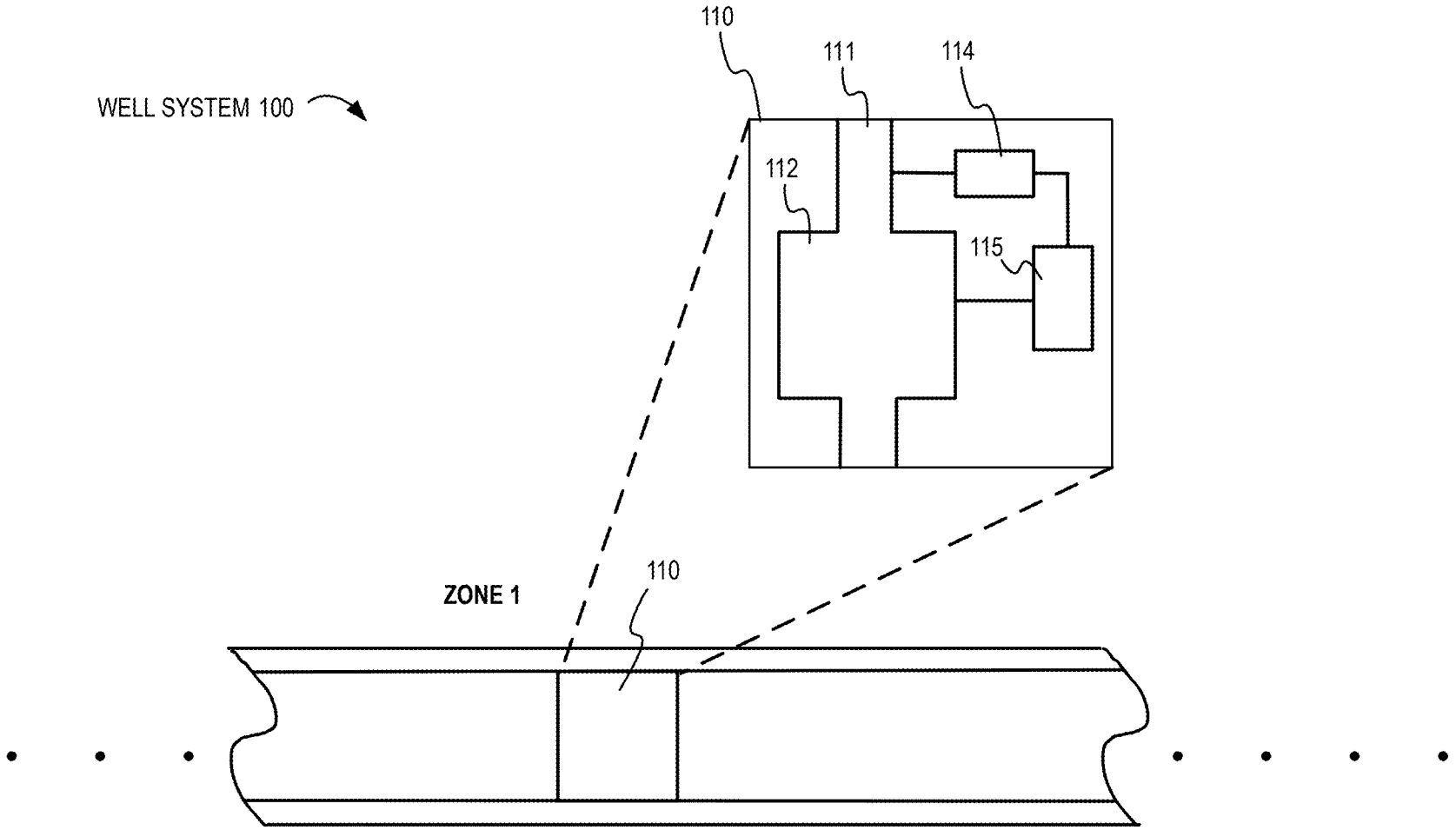
FIG. 1 depicts a schematic diagram of an example well system including one or more flow control devices having a rate limiting device, according to some implementations.
Figure 4:
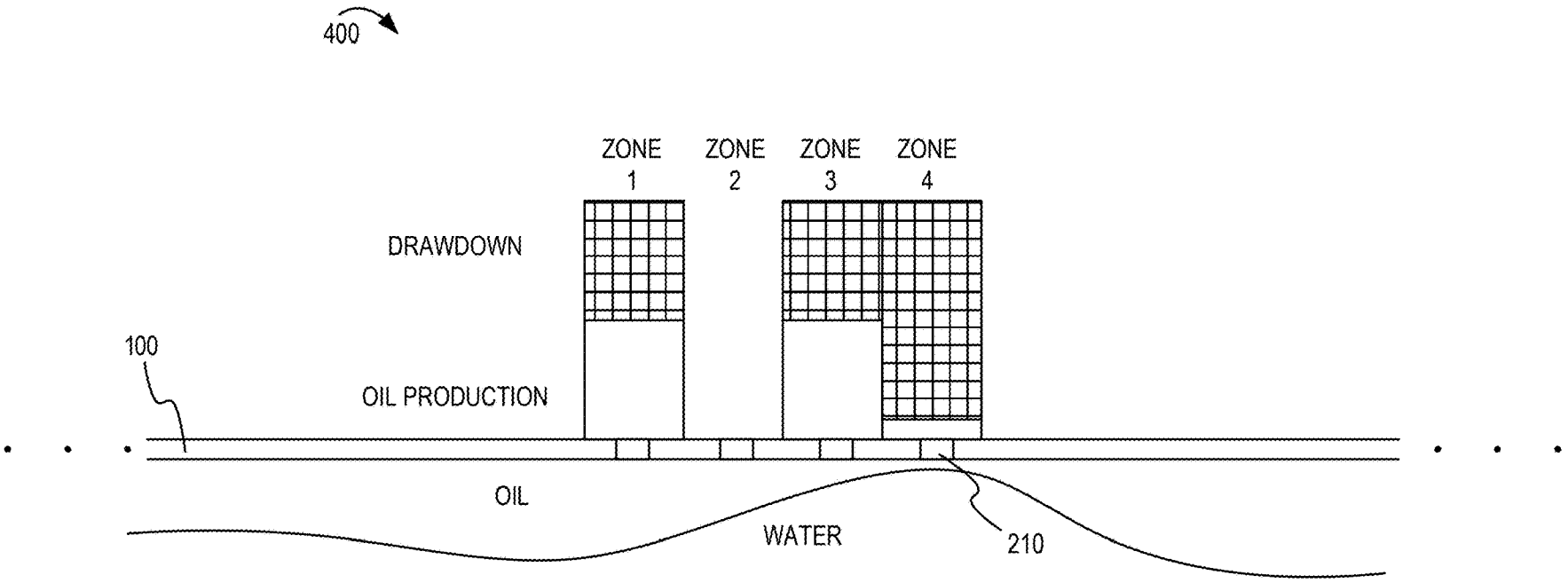
FIG. 4 is a conceptual diagram of a well system having multiple zones and implementing the flow control devices that perform flow control during a water breakthrough in one or more of the zones, according to some implementations.
Figure 7:
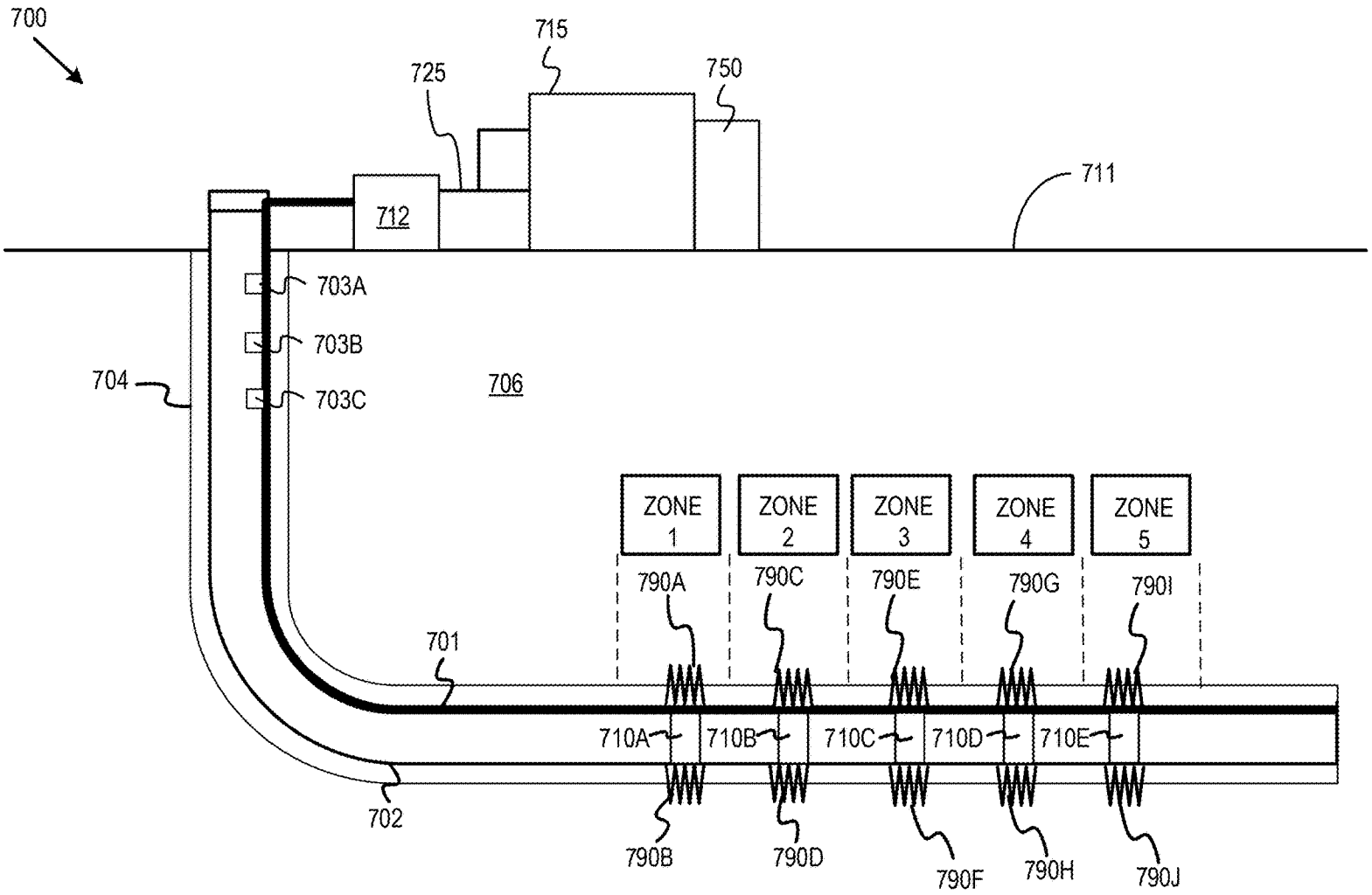
FIG. 7 is a schematic diagram of an example well system including flow control devices having rate limiting devices, according to some implementations.

FIG. 1 depicts a schematic diagram of an example well system 100 including one or more flow control devices having a rate limiting device, according to some implementations. In some implementations, the well system 100 may include a wellbore 102, a casing 104, surface equipment and tools (not shown), and downhole equipment and tools, such as the flow control device 110. FIG. 1 shows a portion of the downhole horizontal section of the well system 100 for simplicity. It is noted that the well system 100 may include multiple zones and multiple flow control devices, as shown in FIGS. 4 and 7. For example, each zone of the well system 100 may include one or more flow control devices (e.g., the flow control device 110). It is also noted that the well system 100 may include additional devices, tools and other components that are not shown for simplicity. In some implementations, the well system 100 may perform fracturing operations, such as hydraulic fracturing operations, for extracting reservoir fluid (e.g., hydrocarbons such as oil and gas) from the subsurface formation. The well system 100 may include a flow control device 110 (or multiple flow control devices) in each zone of the well system 100 to control the fluid flow in the corresponding zone. Each flow control device 110 may include an inlet 111, a valve 112, a rate limiting device 114, and a fluid sensor 115. Fluid may enter the flow control device 110 from the subsurface formation via the inlet 111 and exit the flow control device 110 into the well tubing or piping of the well system 100 for extraction to the surface. Although examples describe the well system 100 as a fracturing well system, it is noted that the well system 100 may be other types of well systems that use flow control devices.

In some implementations, the rate limiting device 114 may be coupled between the inlet 111 and the fluid sensor 115, and the fluid sensor 115 may be coupled with the valve 112. For example, the rate limiting device 114 may be connected to the inlet 111 and may be inline or in series with the fluid sensor 115. FIG. 1 shows one non-limiting example configuration of the rate limiting device 114 and the fluid sensor 115 in the flow control device 110. It is noted, however, that in other implementations the rate limiting device 114 and the fluid sensor 115 may have other configurations in the flow control device 110, e.g., the rate limiting device 114 may be coupled after the fluid sensor 115 or the rate limiting device 114 may be part of the fluid sensor 115 (or vice versa). In some implementations, the flow control device 110 may be any of various types of flow control devices, such as inflow control devices (ICDs) or autonomous ICD (AICDs), among others. In some implementations, the inlet 111 may include a nozzle or other fluid input device. In some implementations, the fluid sensor 115 may be any of various types of fluid sensors (which may also be referred to as fluidic sensors), such as a turbine-based fluid sensor, a density-based fluid sensor, or a viscosity-based fluid sensor, among others. A non-limiting example of a turbine-based fluid sensor is described below in FIGS. 2-3. In some implementations, the rate limiting device 114 may be any of various types of rate limiting devices (which may also be referred to as rate limiters), such as a moving parts rate limiter, a flexural part rate limiter, a non-moving parts rate limiter, a vortex flow rate limiter, or a floating disk rate limiter.

During well operations, such as during the production of oil, the flow control device 110 may control the fluid flow from the subsurface formation to the surface, including allowing the production of desired fluids (such as oil) and restricting the production of undesired fluids (such as water). An autonomous flow control device, such as an AICD, may perform this function automatically and autonomously. The flow control device 110 may include the fluid sensor 115 to sense or detect the desired and undesired fluids. For example, the fluid sensor 115 can detect various properties of the fluid being obtained or extracted from the subsurface formation, such as the fluid type, the fluid composition, and/or fluid metrics, among others. The fluid sensor 115 may modify the fluid flow through the flow control device 110 based on the sensed or detected fluid properties. For example, if an undesired fluid (such as water) is detected based on the fluid properties, the fluid sensor 115 may cause the flow control device 110 to begin to restrict or modify the fluid flow through the flow control device 110. The fluid flow may be restricted or modified in various ways depending on the type or design of the flow control device. For example, the fluid flow may be restricted or modified by performing at least one of partially closing the valve 112, fully closing the valve 112, and/or routing the fluid flow differently through the flow control device 110, among others. In some cases, while performing the flow control operations, the differential pressure and the fluid flow rate may increase to levels that are beyond the recommended or specified levels of the fluid sensor 115 (e.g., in accordance with the sensor specifications) and/or other components of the flow control device 110. For example, when the well system 100 experiences a water breakthrough in one of the zones (e.g., zone 1), the flow control device 110 may modify or restrict the fluid flow (e.g., after the fluid sensor 115 detects the undesired fluid) and thus the differential pressure and the fluid flow rate may increase to high levels that are greater than the recommended or specified levels. A high differential pressure across the fluid sensor 115 and a high fluid flow rate through the fluid sensor 115 may result in excess wear and tear in the components of the flow control device 110 (e.g., the fluid sensor 115), instability in the flow control device 110, and excess undesired fluid production through the flow control device 110, among others.

In some implementations, the rate limiting device 114 may be included in the flow control device 110 to limit the flow rate of the fluid through the fluid sensor 115 to a flow rate threshold. For example, the rate limiting device 114 may be coupled between the inlet 111 and the fluid sensor 115 to limit the flow rate of the fluid through the fluid sensor 115 to a flow rate threshold (which also may be referred to as a sensor flow rate threshold). In a non-limiting example, the flow rate threshold may be 5 gallons per minute (gpm). In another non-limiting example, the flow rate threshold may be 6 gpm. It is noted, however, that the flow rate threshold may be set to any of various other values, e.g., a flow rate threshold value that is set based on the design, type, and/or configuration of the rate limiting device 114. In some implementations, the threshold of the rate limiting device 114 may be described in terms of a differential pressure threshold that corresponds to (or is associated with) the flow rate threshold. Thus, in some implementations, the threshold of the rate limiting device 1114 may be a flow rate threshold, a differential pressure threshold that corresponds to the flow rate threshold, or both. It is noted that the threshold of the rate limiting device 114 may also be other parameters or metrics that correspond to (or are associated with) the flow rate threshold and/or the differential pressure threshold.

In some implementations, when the fluid flow rate reaches the flow rate threshold of the rate limiting device 114, the rate limiting device 114 may activate to restrict the fluid flow. The rate limiting device 114 can restrict the fluid flow to maintain the flow rate at the flow rate threshold even as the differential pressure across the flow control device 110 continues to increase. The rate limiting device 114 may restrict the flow rate to the flow rate threshold and also take on the excess differential pressure to prevent excess wear and tear (and other problems) to other components of the flow control device 110 (e.g., the fluid sensor 115) from the high flow rate and excess differential pressure. The rate limiting device 114 may be inactive (or in a partially inactive state) when the flow rate is less than the flow rate threshold. The rate limiting device 114 may be activated (e.g., fully activated) when the flow rate reaches the flow rate threshold in order to maintain the flow rate at the flow rate threshold.

Figure 2:
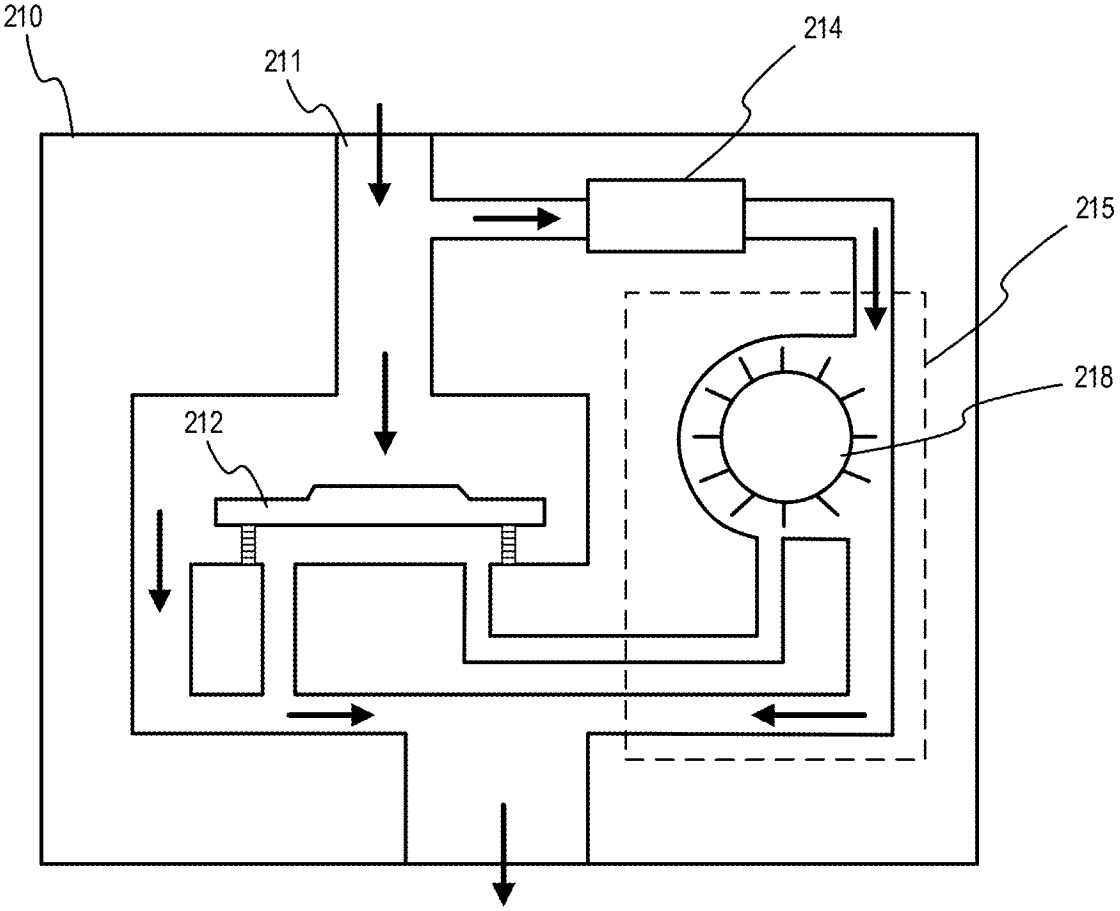
FIG. 2 depicts a schematic diagram of an example flow control device having a rate limiting device in an inactive state, according to some implementations.

FIG. 2 depicts a schematic diagram of an example flow control device 210 having a rate limiting device 214 in an inactive state, according to some implementations. The flow control device 210 and the rate limiting device 214 shown in FIG. 2 are non-limiting examples of the flow control device 110 and the rate limiting device 114 described in FIG. 1. In some implementations, the flow control device 210 may include an inlet 211, a valve 212, a rate limiting device 214, and a fluid sensor 215. In some implementations, the fluid sensor 215 may include a turbine 218. In the non-limiting example shown in FIG. 2, the inlet 211 receives a fluid and has a fluid path to both the valve 212 and the rate limiting device 214. The rate limiting device 214 is coupled between the inlet 211 and the fluid sensor 215. The fluid sensor 215 is coupled to the valve 212 and to the output path (or outlet) of the flow control device 210. In some implementations, the flow control device 210 may be any of various types of flow control devices, such as ICDs or AICDs, among others. In some implementations, the inlet 211 may include a nozzle or other fluid input device. In some implementations, the valve 212 may be any of various types of valves, such as a pilot-operated valve. In some implementations, the fluid sensor 215 may be a turbine-based fluid sensor having the turbine 218. It is noted, however, that in other implementations, the fluid sensor 215 may be a different type of fluid sensor, such as a viscosity-based fluid sensor. In some implementations, the rate limiting device 214 may be any of various types of rate limiting devices, such as a moving parts rate limiter, a flexural part rate limiter, a non-moving parts rate limiter, a vortex flow rate limiter, or a floating disk rate limiter. As described in FIG. 1, the fluid sensor 215 may monitor and sense the fluid received via the inlet 211 and may control the fluid flow based on the fluid properties of the sensed fluid. The rate limiting device 214 may limit the flow rate of the received fluid to a flow rate threshold to prevent high flow rates and high differential pressures that can cause wear and tear on components of the flow control device 210 (e.g., such as the fluid sensor 215).

In some implementations, the rate limiting device 214 may be coupled in line (or in series) with the fluid sensor 215. For example, the rate limiting device 214 may be coupled in line (or in series) with the turbine 218 of the fluid sensor 215. In some implementations, the rate limiting device 214 can be configured to limit the fluid flow rate to a flow rate threshold. The rate limiting device 214 may limit the flow rate to the turbine 218 to a flow rate that is sufficient to generate the revolutions per minute (RPMs) the turbine 218 needs for the fluid sensor 215 to perform the sensing and control functions for the flow control device 210. In a conventional flow control device with a fixed nozzle entry, as the differential pressure across the system increases, so does the flow rate to the turbine, which may result in excess RPMs, excess erosional wear, instability, and excess undesired fluid production. In the flow control device 210 shown in FIG. 2, the rate limiting device 214 limits the flow rate to the flow rate threshold and the rate limiting device 214 also takes on the excess differential pressure drop. For example, the differential pressure across the rate limiting device 214 may increase as the flow rate increases up to the flow rate threshold and as the rate limiting device 214 maintains the flow rate at the flow rate threshold. When restricting the fluid flow rate, the rate limiting device 214 may route just enough fluid to the turbine 218 for it to produce the necessary artificial gravity and flow rate through the turbine 218 for the fluid sensor 215 to perform the sensing and control functions, while reducing the risk of turbine overspeed, excess wear and tear, and excessive undesired fluid production.

In some implementations, under a normal flow scenario, the rate limiting device 214 may not be activated or may be partially activated, and the rate limiting device 214 may have a limited pressure drop across the device or a limited differential pressure. When the fluid is the desired type of fluid (e.g., oil) and the rate limiting device 214 is inactivated (or partially inactivated), the fluid flows as shown by the arrows in FIG. 2. The fluid may enter via the inlet 211, and may flow through the flow control device 210 via two separate paths. Most of the fluid may flow via the large fluid path that is created when the valve 212 is in an open position. The remaining portion of the fluid may flow via the fluid path that includes the rate limiting device 214 and the fluid sensor 215 (including the turbine 218). The fluid from both paths may exit the flow control device 210 via the same output path (or outlet), which may send the fluid to the well tube or pipe for extraction to the surface. The fluid continues to flow as shown in FIG. 2 when the fluid sensor 215 senses that the fluid flow is the desired type of fluid. When the fluid sensor 215 senses an undesired type of fluid, the fluid flow is modified by the fluid sensor 215 and the valve 212, as shown in FIG. 3.

Figure 3:
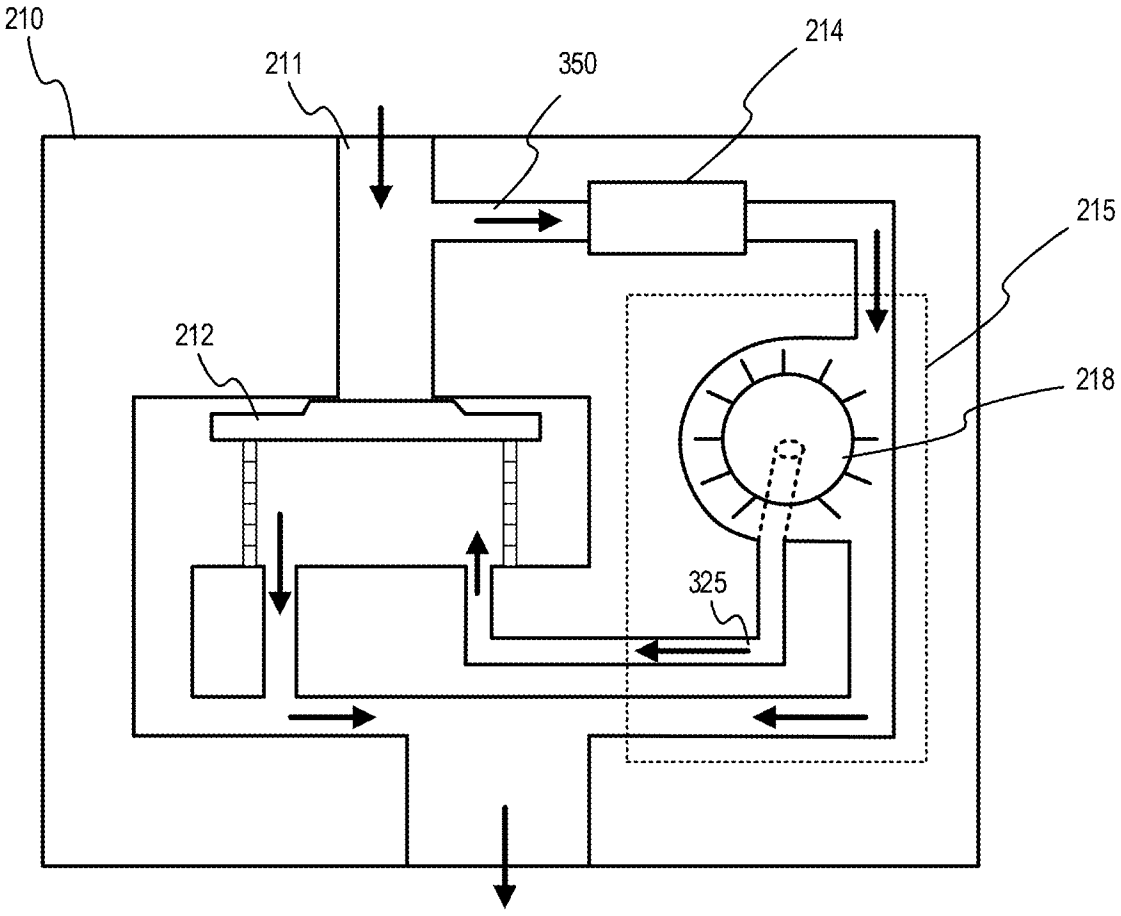
FIG. 3 depicts a schematic diagram of an example flow control device having a rate limiting device in an activated state, according to some implementations.

FIG. 3 depicts a schematic diagram of an example flow control device 210 having a rate limiting device 214 in an activated state, according to some implementations. Similar to FIG. 2, in some implementations, the flow control device 210 may include an inlet 211, a valve 212, a rate limiting device 214, and a fluid sensor 215, and the fluid sensor 215 may include a turbine 218. In some implementations, when the fluid sensor 215 senses an undesired type of fluid, the fluid flow is modified by the fluid sensor 215 and the valve 212. For example, as shown in FIG. 3, the valve 212 may be pushed up to a closed position when the fluid sensor 215 senses and undesired type of fluid (e.g., water), which closes the main flow path through the flow control device 210. As shown in the conceptual diagram 400 of FIG. 4, an undesired fluid, such as water, may begin to be extracted along with the desired fluid in one or more of the zones of the well system 100 when there is a water breakthrough in the one or more zones. FIG. 4 shows water breakthrough in zone 4, which results in a high drawdown condition (as less pressure loss is seen from the formation) that causes the oil production to decrease substantially compared to the other zones (e.g., zones 1 and 3). During the high drawdown condition, the rate limiting device 214 of the flow control device 210 may be activated to limit the fluid flow and limit the velocity impinging the blades of the turbine 218, which reduces the maximum turbine RPMs (or the angular velocity), reduces the erosional wear on the turbine 218, and reduces the production of the undesired fluid. In another scenario, a high drawdown condition may be encountered when the flow control device 210 is placed in fluid communication with a natural fracture in the subsurface formation.

During a high drawdown condition, in some implementations, the turbine 218 of the fluid sensor 215 may sense the undesired type of fluid, which may trigger a fluid flow via a pilot path 325. The fluid flow through the pilot path 325 provides a pressure on the valve 212 that results in the valve 212 being closed. It is noted that in some implementations the valve 212 may be referred to as a pilot operated valve since the pilot fluid flow via the pilot path 325 can change the position of the valve 212 (e.g., from an open position to a closed position and vice versa). When the valve 212 is in a closed position, the main flow path of the flow control device 210 is closed or restricted, and thus most or all of the fluid flow takes place through the sensor path 350 (which may also be referred to as the secondary flow path). When the fluid flows through the smaller sensor path 350, the differential pressure increase across the flow rate device 210 and the fluid flow rate increases through the sensor path 350. In some implementations, the rate limiting device 214 is positioned in the sensor path 350 to limit the flow rate of the fluid to the flow rate threshold, as described previously in FIGS. 1-2. The rate limiting device 214 may be considered to be activated (or in an active state) when the rate limiting device 214 is limiting and maintaining the flow rate at the flow rate threshold associated with the rate limiting device 214. In a non-limiting example, the flow rate threshold may be 5 gallons per minute (gpm). In another non-limiting example, the flow rate threshold may be 6 gpm. It is noted, however, that the flow rate threshold may be set to any of various other values, e.g., a flow rate threshold value that is set based on the design, type, and/or configuration of the rate limiting device 214.

In some implementations, using the rate limiting device 214 within the flow control device 210 may enable a higher differential pressure performance envelope, as the rate limiting device 214 can eliminate the concern of over revving the turbine 218. The turbine blades can see lower velocity particle impingement during high differential pressure applications, which can increase the useful life of the turbine with respect to erosional wear on the blades. The bearings of the turbine 218 may be able to be more cost effective since the turbine 218 does not need to withstand high RPMs conditions. Also, dynamic balancing of the turbine 218 may not be needed since the RPMs of the turbine 218 can be maintained at lower RPMs compared to designs that do not use the rate limiting device 214.

Figure 5:
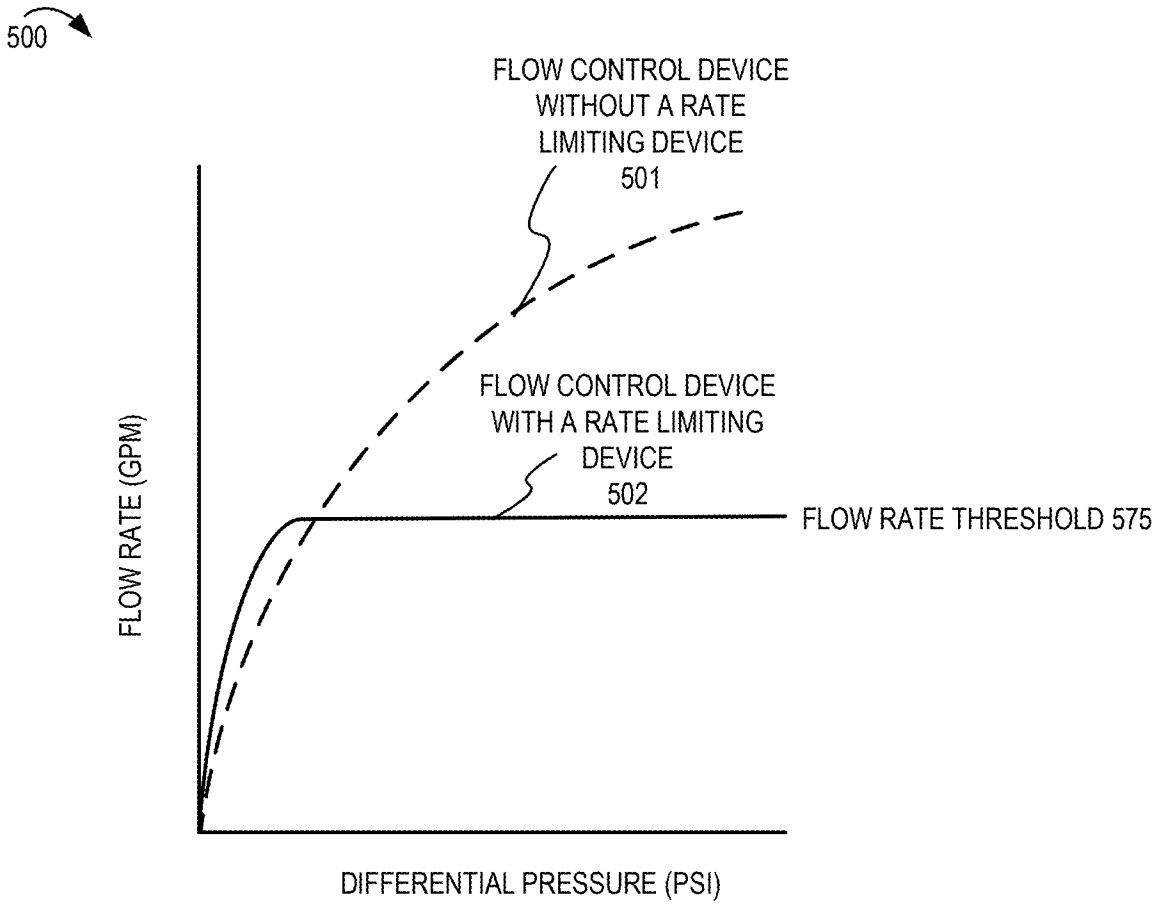
FIG. 5 depicts a plot showing how a flow control device having a rate limiting device limits the fluid flow rate.

FIG. 5 depicts a plot 500 showing how a flow control device having a rate limiting device limits the fluid flow rate. As shown in FIG. 5, the curve 501 shows that the flow rate increases as the differential pressure increases in flow control devices that do not have a rate limiting device. As described above in FIGS. 1-4, a high flow rate can cause problems in one or more components of the flow control device, such as causing excess wear and tear in the fluid sensor. Curve 502 shows that the flow rate is limited to the flow rate threshold 575 even as the differential pressure increases in flow control devices (e.g., such as the flow control device 210) that have a rate limiting device (e.g., such the rate limiting device 214). As a non-limiting example, if the turbine 218 of the fluid sensor 215 needs a flow rate of 4 gpm to function, then any flow rate above a threshold of 4 gpm is restricted by the rate limiting device 214. This can result in an increase in the oil-to-water ratio in the case of water entering the flow control device 210 in a high drawdown and high differential pressure condition.

Figure 6:
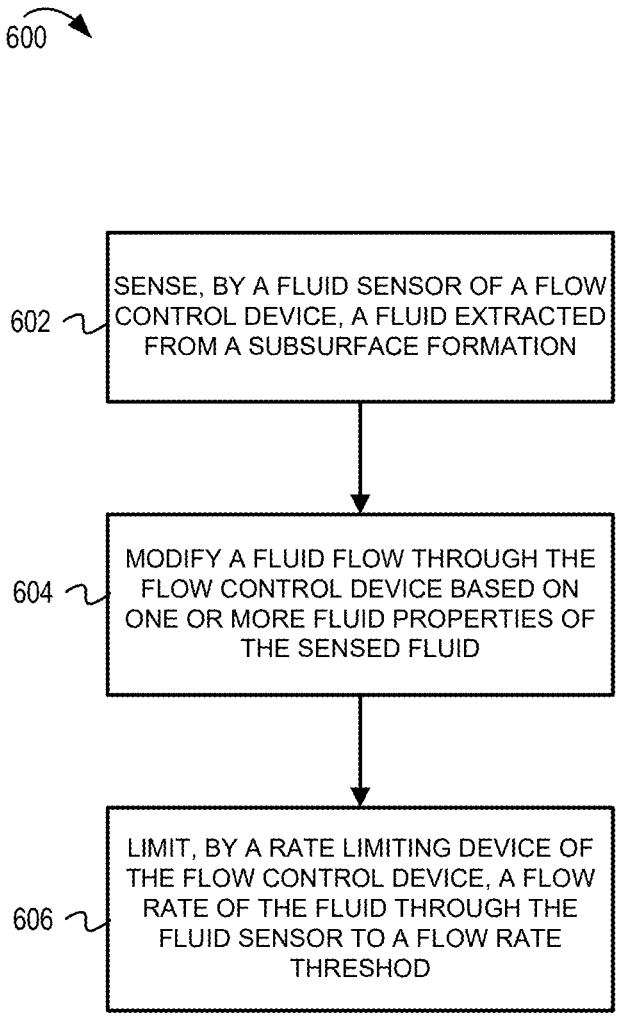
FIG. 6 is a flowchart of example operations for fluid flow control in a flow control device of a well system, according to some implementations.

FIG. 6 is a flowchart 600 of example operations for fluid flow control in a flow control device of a well system, according to some implementations. In some implementations, the fluid extracted from a subsurface formation is sensed by a fluid sensor of the flow control device (block 602). In some implementations, the fluid flow through the flow control device is modified based on one or more fluid properties of the sensed fluid (block 604). In some implementations, the flow rate of the fluid through the fluid sensor is limited to a flow rate threshold by a rate limiting device of the flow control device (block 606).

In some implementations, the fluid is received via an inlet of the flow control device from the subsurface formation. The rate limiting device is coupled between the inlet and the fluid sensor for limiting the flow rate of the fluid through the fluid sensor to the flow rate threshold. In some implementations, the fluid flow is restricted through a main flow path of the flow control device when the one or more fluid properties indicate an undesired fluid being extracted from the subsurface formation. The flow rate of the fluid through the fluid sensor in a secondary flow path of the flow control device is limited to the flow rate threshold after a differential pressure across the flow control device increases due to the restricted fluid flow through the main flow path. In some implementations, the fluid sensor is a turbine-based fluid sensor that includes a turbine for sensing the one or more fluid properties and modifying the fluid flow through the flow control device. The rate limiting device is configured to limit the flow rate of the fluid through the fluid sensor to limit an angular velocity of the turbine from the fluid flow.

FIG. 7 is a schematic diagram of an example well system including flow control devices having rate limiting devices, according to some implementations. A well system 700 may comprise a wellbore 704 in a subsurface formation 706. The wellbore 704 may include a casing 702 and a number of perforations 790A-790J being made in the casing 702 at different depths as part of hydraulic fracturing to allow hydraulic communication between the subsurface formation 706 and the casing 702 and to allow fracturing at different zones, such as zones 1-5 shown in FIG. 7. The well system 700 may include a plurality of flow control devices 710A-E that are each representative of the flow control device 110 of FIG. 1 and/or flow control device 210 of FIG. 2. The flow control devices 710A-E may each include a fluid sensor and a rate limiting device, as described above in FIGS. 1-6. The flow control devices 710A-E and the corresponding fluid sensors and rate limiting devices may have the features and perform the operations described above in FIGS. 1-6 for fluid flow control. The well system 700 may also include a computer system 715 for monitoring, analyzing, and controlling the well operations.

In some implementations, the well system 700 also may include a fiber optic cable 701. In some implementations, the fiber optic cable 701 may be temporarily deployed (e.g., using a deployment tool) and can be removed from the wellbore 704. In some implementations, the fiber optic cable 701 may be cemented in place in the annular space between the casing 702 of the wellbore 704 and the subsurface formation 706. In some implementations, the fiber optic cable 701 may be clamped to the outside of the casing 702 during deployment and protected by centralizers and cross coupling clamps. The fiber optic cable 701 may house one or more optical fibers, and the optical fibers may be single mode fibers, multi-mode fibers, or a combination of single mode and multi-mode optical fibers.

In some implementations, the fiber optic cable 701 may be used for distributed sensing where acoustic, strain, and temperature data may be collected. The data may be collected at various positions distributed along the fiber optic cable 701. For example, data may be collected every 1-3 ft along the full length of the fiber optic cable 701. The fiber optic cable 701 may be included with coiled tubing, wireline, loose fiber using coiled tubing, or gravity deployed fiber coils that unwind the fiber as the coils are moved in the wellbore 704. The fiber optic cable 701 also may be deployed with pumped down coils and/or self-propelled containers. Additional deployment options for the fiber optic cable 701 may include coil tubing and wireline deployed coils where the fiber optic cable 701 is anchored at the toe of the wellbore 704. In such embodiments, the fiber optic cable 701 may be deployed when the wireline or coiled tubing is removed from the wellbore 704. The distribution of sensors shown in FIG. 7 is for example purposes only. Any suitable sensor deployment may be used. For example, the well system 700 may include fiber optic cable deployed sensors or sensors cemented into the casing. Different types of sensors deployments also may be combined in a single well, such as including both sensors cemented to the casing and sensors in plugs, flow metering devices, etc. in a single well system.

In some implementations, a fiber optic interrogation unit 712 may be located on the surface 711 of the well system 700. The fiber optic interrogation unit 712 may be directly coupled to the fiber optic cable 701. Alternatively, the fiber optic interrogation unit 712 may be coupled to a fiber stretcher module, wherein the fiber stretcher module is coupled to the fiber optic cable 701. The fiber optic interrogation unit 712 may receive measurement values taken and/or transmitted along the length of the fiber optic cable 701 such as acoustic, temperature, strain, etc. The fiber optic interrogation unit 712 may be electrically connected to a digitizer to convert optically transmitted measurements into digitized measurements. The well system 700 may contain multiple sensors, such as sensors 703A-C. There may be any suitable number of sensors placed at any suitable location in the wellbore 704. The sensors 703A-C may include pressure sensors, distributed fiber optic sensors, point temperature sensors, point acoustic sensors, interferometric sensors or point strain sensors. Distributed fiber optic sensors may be capable of measuring distributed acoustic data, distributed temperature data, and distributed strain data. Any of the sensors 703A-C may be communicatively coupled (not shown) to other components of the well system 700 (e.g., the computer 715). In some implementations, the sensors 703A-C may be cemented to a casing 702.

In some implementations, the computer 715 may also receive the electrically transmitted measurements from the fiber optic interrogation unit 712 using a connector 725. The computer 715 may include a signal processor to perform various signal processing operations on signals captured by the fiber optic interrogation unit 712 and/or other components of the well system 700. The computer 715 may have one or more processors and a memory device to analyze the measurements and graphically represent analysis results on the display device 750.

In some implementations, the fiber optic interrogation unit 712 may operate using various sensing principles including but not limited to amplitude-based sensing systems like Distributed Temperature Sensing (DTS), DAS, Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and, in particular, coherent Rayleigh scattering. A DSS system may be a strain sensing system using dynamic strain measurements based on interferometric sensors (e.g., sensors 703A-C) or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 712 may measure changes in optical fiber properties between two points in the optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems may be sensitive to temperature and mechanical, as well as acoustically induced, vibrations. The fiber optic interrogation unit 712 may capture DAS data in the time domain. One or more components of the well system 700 may convert the DAS data from the time domain to frequency domain data using Fast Fourier Transforms (FFT) and other transforms. For example, wavelet transforms may also be used to generate different representations of the DAS data. Various frequency ranges may be used for different purposes and where low frequency signal changes may be attributed to formation strain changes or fluid movement and other frequency ranges may be indicative of fluid or gas movement. Various filtering techniques may be applied to generate indicators of events related to measuring the flow of fluid.

In some implementations, DAS measurements along the wellbore 704 may be used as an indication of fluid flow through the casing 702 in the wellbore 704. Vibrations and/or acoustic profiles may be recorded and stacked over time, where a simple approach could correlate total energy or recorded signal strength with known flow rates. For example, the fiber optic interrogation unit 712 may measure energy and/or amplitude in multiple frequency bands where changes in select frequency bands may be associated with oil, water and/or gas thus enabling multiphase production profiling along the wellbore 704.

Although some example well systems are shown in FIGS. 1-7, it is noted, however, that the flow control device having a rate limiting device and operations described in FIGS. 1-7 can be used in any type of well system in the oil and gas industry. For example, the well systems may be any type of drilling well systems, fracturing well systems, completion well systems, and producing well systems.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently.

While the aspects of the disclosure are described with reference to various implementations and exploitations, it will be understood that these aspects are illustrative and that the scope of the claims is not limited to them. In general, techniques for determining the corrected boundary information (including uncertainty) for the formation bed boundary of the subsurface formation as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

Furthermore, unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

EXAMPLE EMBODIMENTS

Example Embodiments can include the following:

Embodiment #1: A flow control device for a well system, the flow control device comprising: a fluid sensor configured to sense a fluid extracted from a subsurface formation and modify a fluid flow through the flow control device based on one or more fluid properties of the sensed fluid; and a rate limiting device coupled with the fluid sensor, the rate limiting device configured to limit a flow rate of the fluid through the fluid sensor to a flow rate threshold.

Embodiment #2: The flow control device of Embodiment #1, wherein the fluid sensor is a turbine-based fluid sensor, a density-based fluid sensor, or a viscosity-based fluid sensor.

Embodiment #3: The flow control device of Embodiment #1, wherein the rate limiting device is a moving parts rate limiter, a flexural part rate limiter, a non-moving parts rate limiter, a vortex flow rate limiter, or a floating disk rate limiter.

Embodiment #4: The flow control device of Embodiment #1, further comprising: an inlet configured to receive the fluid from the subsurface formation, wherein the rate limiting device is coupled between the inlet and the fluid sensor to limit the flow rate of the fluid through the fluid sensor to the flow rate threshold.

Embodiment #5: The flow control device of Embodiment #4, further comprising: a valve coupled with the inlet via a main flow path of the flow control device, wherein the rate limiting device is coupled between the inlet and the fluid sensor in a secondary flow path of the flow control device.

Embodiment #6: The flow control device of Embodiment #1, wherein the fluid sensor is a turbine-based fluid sensor that includes a turbine for sensing the one or more fluid properties and modifying the fluid flow through the flow control device, wherein the rate limiting device is configured to limit the flow rate of the fluid through the fluid sensor to limit an angular velocity of the turbine from the fluid flow.

Embodiment #7: The flow control device of Embodiment #1, wherein: the fluid sensor configured to modify the fluid flow through the flow control device based on the one or more fluid properties of the sensed fluid includes the fluid sensor configured to restrict the fluid flow through a main flow path of the flow control device when the one or more fluid properties indicate an undesired fluid being extracted from the subsurface formation; and the rate limiting device is configured to limit the flow rate of the fluid through the fluid sensor in a secondary flow path of the flow control device to the flow rate threshold after a differential pressure across the flow control device increases due to the restricted fluid flow through the main flow path.

Embodiment #8: The flow control device of Embodiment #1, wherein the one or more fluid properties include at least one of a fluid type, a fluid composition, or a fluid measurement.

Embodiment #9: The flow control device of Embodiment #1, wherein the flow rate threshold is a flow rate limit through the fluid sensor that allows operation of the fluid sensor, reduces a differential pressure and the flow rate across the fluid sensor, and reduces production of undesired fluid.

Embodiment #10: A well system, comprising: a well tube; and a flow control device coupled with the well tube, the flow control device including: a fluid sensor configured to sense a fluid extracted from a subsurface formation and modify a fluid flow through the flow control device based on one or more fluid properties of the sensed fluid; and a rate limiting device coupled with the fluid sensor, the rate limiting device configured to limit a flow rate of the fluid through the fluid sensor to a flow rate threshold.

Embodiment #11: The well system of Embodiment #10, wherein the fluid sensor is a turbine-based fluid sensor, a density-based fluid sensor, or a viscosity-based fluid sensor.

Embodiment #12: The well system of Embodiment #10, wherein the rate limiting device is a moving parts rate limiter, a flexural part rate limiter, a non-moving parts rate limiter, a vortex flow rate limiter, or a floating disk rate limiter.

Embodiment #13: The well system of Embodiment #10, further comprising a plurality of flow control devices, each of the plurality of flow control devices including a corresponding fluid sensor and a corresponding rate limiting device, wherein the well tube includes a plurality of zones, each zone including a corresponding one of the plurality of flow control devices.

Embodiment #14: The well system of Embodiment #10, wherein the flow control device further includes: an inlet configured to receive the fluid from the subsurface formation, wherein the rate limiting device is coupled between the inlet and the fluid sensor to limit the flow rate of the fluid through the fluid sensor to the flow rate threshold.

Embodiment #15: The well system of Embodiment #14, further comprising: a valve coupled with the inlet via a main flow path of the flow control device, wherein the rate limiting device is coupled between the inlet and the fluid sensor in a secondary flow path of the flow control device.

Embodiment #16: The well system of Embodiment #10, wherein the fluid sensor is a turbine-based fluid sensor that includes a turbine for sensing the one or more fluid properties and modifying the fluid flow through the flow control device, wherein the rate limiting device is configured to limit the flow rate of the fluid through the fluid sensor to limit an angular velocity of the turbine from the fluid flow.

Embodiment #17: The well system of Embodiment #10, wherein: the fluid sensor configured to modify the fluid flow through the flow control device based on the one or more fluid properties of the sensed fluid includes the fluid sensor configured to restrict the fluid flow through a main flow path of the flow control device when the one or more fluid properties indicate an undesired fluid being extracted from the subsurface formation; and the rate limiting device is configured to limit the flow rate of the fluid through the fluid sensor in a secondary flow path of the flow control device to the flow rate threshold after a differential pressure across the flow control device increases due to the restricted fluid flow through the main flow path.

Embodiment #18: A method for fluid flow control in a flow control device of a well system, comprising: sensing, by a fluid sensor of the flow control device, a fluid extracted from a subsurface formation; modifying a fluid flow through the flow control device based on one or more fluid properties of the sensed fluid; and limiting, by a rate limiting device of the flow control device, a flow rate of the fluid through the fluid sensor to a flow rate threshold.

Embodiment #19: The method of Embodiment #18, further comprising: receiving, via an inlet of the flow control device, the fluid from the subsurface formation, wherein the rate limiting device is coupled between the inlet and the fluid sensor for limiting the flow rate of the fluid through the fluid sensor to the flow rate threshold.

Embodiment #20: The method of Embodiment #18, wherein: modifying the fluid flow through the flow control device based on the one or more fluid properties of the sensed fluid includes restricting the fluid flow through a main flow path of the flow control device when the one or more fluid properties indicate an undesired fluid being extracted from the subsurface formation; and limiting the flow rate of the fluid through the fluid sensor includes limiting the flow rate of the fluid through the fluid sensor in a secondary flow path of the flow control device to the flow rate threshold after a differential pressure across the flow control device increases due to the restricted fluid flow through the main flow path.

What is claimed is:

1. A flow control device for a well system, the flow control device comprising:

a fluid sensor configured to sense a fluid extracted from a subsurface formation and modify a fluid flow through the flow control device based on one or more fluid properties of the sensed fluid; and a rate limiting device coupled with the fluid sensor, the rate limiting device configured to operate in an initial state to allow a flow rate of the fluid through the fluid sensor to increase when the flow rate is less than a flow rate threshold, and the rate limiting device configured to transition to a flow-limiting state to limit the flow rate of the fluid through the fluid sensor to the flow rate threshold when a differential pressure across the flow control device increases and the flow rate of the fluid reaches the flow rate threshold, wherein the increase in the differential pressure across the flow control device includes an excess differential pressure across the rate limiting device.

2. The flow control device of claim 1, wherein the fluid sensor is a turbine-based fluid sensor, a density-based fluid sensor, or a viscosity-based fluid sensor.

3. The flow control device of claim 1, wherein the rate limiting device is a moving parts rate limiter, a flexural part rate limiter, or a floating disk rate limiter.

4. The flow control device of claim 1, further comprising:

an inlet configured to receive the fluid from the subsurface formation, wherein the rate limiting device is coupled between the inlet and the fluid sensor to limit the flow rate of the fluid through the fluid sensor to the flow rate threshold.

5. The flow control device of claim 4, further comprising:

a valve coupled with the inlet via a main flow path of the flow control device, wherein the rate limiting device is coupled between the inlet and the fluid sensor in a secondary flow path of the flow control device.

6. The flow control device of claim 1, wherein the fluid sensor is a turbine-based fluid sensor that includes a turbine for sensing the one or more fluid properties and modifying the fluid flow through the flow control device, wherein the rate limiting device is configured to limit the flow rate of the fluid through the fluid sensor to limit an angular velocity of the turbine from the fluid flow.

7. The flow control device of claim 1, wherein:

the fluid sensor configured to modify the fluid flow through the flow control device based on the one or more fluid properties of the sensed fluid includes the fluid sensor configured to restrict the fluid flow through a main flow path of the flow control device when the one or more fluid properties indicate an undesired fluid being extracted from the subsurface formation; and the rate limiting device is configured to limit the flow rate of the fluid through the fluid sensor in a secondary flow path of the flow control device to the flow rate threshold after the differential pressure across the flow control device increases due to the restricted fluid flow through the main flow path.

8. The flow control device of claim 1, wherein the one or more fluid properties include at least one of a fluid type, a fluid composition, or a fluid measurement.

9. The flow control device of claim 1, wherein the flow rate threshold is a flow rate limit through the fluid sensor that allows operation of the fluid sensor, reduces a differential pressure and the flow rate across the fluid sensor, and reduces production of undesired fluid.

10. The flow control device of claim 1, wherein, during the flow-limiting state, the rate limiting device is further configured to maintain the flow rate at the flow rate threshold when the differential pressure continues to increase after the flow rate reaches the flow rate threshold.

11. A well system, comprising:

a well tube; and a flow control device coupled with the well tube, the flow control device including:

a fluid sensor configured to sense a fluid extracted from a subsurface formation and modify a fluid flow through the flow control device based on one or more fluid properties of the sensed fluid; and a rate limiting device coupled with the fluid sensor, the rate limiting device configured to operate in an initial state to allow a flow rate of the fluid through the fluid sensor to increase when the flow rate is less than a flow rate threshold, and the rate limiting device configured to transition to a flow-limiting state to limit the flow rate of the fluid through the fluid sensor to the flow rate threshold when a differential pressure across the flow control device increases and the flow rate of the fluid reaches the flow rate threshold, wherein the increase in the differential pressure across the flow control device includes an excess differential pressure across the rate limiting device.

12. The well system of claim 11, wherein the fluid sensor is a turbine-based fluid sensor, a density-based fluid sensor, or a viscosity-based fluid sensor.

13. The well system of claim 11, wherein the rate limiting device is a moving parts rate limiter, a flexural part rate limiter, or a floating disk rate limiter.

14. The well system of claim 11, further comprising a plurality of flow control devices, each of the plurality of flow control devices including a corresponding fluid sensor and a corresponding rate limiting device, wherein the well tube includes a plurality of zones, each zone including a corresponding one of the plurality of flow control devices.

15. The well system of claim 11, wherein the flow control device further includes:

an inlet configured to receive the fluid from the subsurface formation, wherein the rate limiting device is coupled between the inlet and the fluid sensor to limit the flow rate of the fluid through the fluid sensor to the flow rate threshold.

16. The well system of claim 15, further comprising:

a valve coupled with the inlet via a main flow path of the flow control device, wherein the rate limiting device is coupled between the inlet and the fluid sensor in a secondary flow path of the flow control device.

17. The well system of claim 11, wherein the fluid sensor is a turbine-based fluid sensor that includes a turbine for sensing the one or more fluid properties and modifying the fluid flow through the flow control device, wherein the rate limiting device is configured to limit the flow rate of the fluid through the fluid sensor to limit an angular velocity of the turbine from the fluid flow.

18. The well system of claim 11, wherein:

the fluid sensor configured to modify the fluid flow through the flow control device based on the one or more fluid properties of the sensed fluid includes the fluid sensor configured to restrict the fluid flow through a main flow path of the flow control device when the one or more fluid properties indicate an undesired fluid being extracted from the subsurface formation; and the rate limiting device is configured to limit the flow rate of the fluid through the fluid sensor in a secondary flow path of the flow control device to the flow rate threshold after the differential pressure across the flow control device increases due to the restricted fluid flow through the main flow path.

19. A method for fluid flow control in a flow control device of a well system, comprising:

sensing, by a fluid sensor of the flow control device, a fluid extracted from a subsurface formation;

modifying a fluid flow through the flow control device based on one or more fluid properties of the sensed fluid;

allowing, by a rate limiting device of the flow control device while operating in an initial state, a flow rate of the fluid through the fluid sensor to increase when the flow rate is less than a flow rate threshold, and limiting, by the rate limiting device of the flow control device after transitioning to a flow-limiting state, the flow rate of the fluid through the fluid sensor to the flow rate threshold when a differential pressure across the flow control device increases and the flow rate of the fluid reaches the flow rate threshold, wherein the increase in the differential pressure across the flow control device includes an excess differential pressure across the rate limiting device.

20. The method of claim 19, further comprising:

receiving, via an inlet of the flow control device, the fluid from the subsurface formation, wherein the rate limiting device is coupled between the inlet and the fluid sensor for limiting the flow rate of the fluid through the fluid sensor to the flow rate threshold.

21. The method of claim 19, wherein:

modifying the fluid flow through the flow control device based on the one or more fluid properties of the sensed fluid includes restricting the fluid flow through a main flow path of the flow control device when the one or more fluid properties indicate an undesired fluid being extracted from the subsurface formation; and limiting the flow rate of the fluid through the fluid sensor includes limiting the flow rate of the fluid through the fluid sensor in a secondary flow path of the flow control device to the flow rate threshold after the differential pressure across the flow control device increases due to the restricted fluid flow through the main flow path.

* * * * *